US005786743A

United States Patent [19]

Viscogliosi

[11] Patent Number: 5,786,743

[45] Date of Patent: Jul. 28, 1998

[54] FUSE CARTRIDGE OF THE TYPE INCORPORATING AN OPERATION INDICATOR

[75] Inventor: Joël Viscogliosi, Brindas, France

[73] Assignee: Ferraz, Lyons, France

[21] Appl. No.: 746,216

[22] Filed: Nov. 7, 1996

[30] Foreign Application Priority Data

Nov. 8, 1995 [FR] France ..... 95 13435

[51] Int. Cl.[6] ..... H01H 85/30

[52] U.S. Cl. ..... 337/206; 337/241; 337/242; 337/267

[58] Field of Search ..... 337/244, 267, 337/265, 241, 206, 266, 305, 314, 353, 412; 200/341, 574, 573

[56] References Cited

U.S. PATENT DOCUMENTS 3,248,956 5/1966 Kuhn ..... 74/54

3,980,852 9/1976 Redfield ..... 200/153

5,260,679 11/1993 Viscogliosi .

FOREIGN PATENT DOCUMENTS 1813188 3/1960 Germany .

*Primary Examiner*—Leo P. Picard

*Assistant Examiner*—Anatoly Vortman

*Attorney, Agent, or Firm*—Dowell & Dowell, P.C.

[57] ABSTRACT

Between a rocking lever controlled by a striking pin of a cartridge and a resiliently loaded actuation knob of an alarm micro-switch, there is interposed an arm mounted on a pivot which pivot is spaced from the movement axis of the knob with result that the knob is engaged by the arm virtually without any mutual lateral sliding therebetween.

4 Claims, 2 Drawing Sheets

FUSE CARTRIDGE OF THE TYPE INCORPORATING AN OPERATION INDICATOR

BACKGROUND OF THE INVENTION

1. Field of the Invention

The present invention relates to fuse cartridges intended for protecting electric circuits and it concerns more particulary devices of this type which are equipped with an operation indicator adapted permanently to inform as to the state of the fuse or fuses incorporated therein.

2. History of the Related Art

It is known that this type of cartridge is generally provided with a signalling striking pin which is retained against elastic return means by a conducting wire of small section mounted in parallel with the fuse element or elements of the cartridge. This wire is immediately broken in the event of fusion of the fuse element or elements, so that the striking pin, thus released, acts against the actuation knob of a micro-switch connected to the supply of an alarm circuit.

Document FR-A-2 685 544 (FERRAZ) proposes interposing, between the actuation knob of the alarm micro-switch and the striking pin, a rocking lever which is profiled as a cam in order to give the micro-switch two stable operating positions, whatever the arrangement of its interior mechanism. Among other advantages, this original arrangement makes it possible to employ micro-switches of the monostable type instead of bistable micro-switches which are more expensive and take up more room.

In the form of embodiment described and illustrated in the document mentioned above, the rocking lever includes two arms oriented perpendicularly to each other, while a central part included between the arms is profiled to comprise two bearing surfaces, themselves oriented at right angles. It is this profiled central part which is in contact with the actuation knob of the micro-switch and whose displacement under the effect of the release of the striking pin ensures control of the knob.

Now, experience has shown that correct functioning of the system was in fact a function of the surface state of the parts in contact, certain synthetic materials presenting a very low coefficient of friction. This is particularly so in the case of sealed micro-switches whose actuation knob is housed inside an impermeable cap in the form of a capsule or bellows; the deformable synthetic material of this cap has a very high coefficient of friction which may block operation of the assembly, the effort furnished by the striking pin being insufficient to pivot the rocking lever.

SUMMARY OF THE INVENTION

It is an object of the present invention to overcome this drawback and it consists in providing, between the profiled central part of the rocking lever and the actuation knob of the micro-switch, an arm which is articulated at a point sufficiently distant from the knob for the curved path of its free end to be able to be assimilated to a straight line oriented substantially along the axis of the knob, thus virtually eliminating any lateral component capable of provoking an effect of slide at the zone of contact.

It will be appreciated that any effect of braking is consequently eliminated, while ensuring at the same time perfect operation whatever the nature of the surfaces in contact.

BRIEF DESCRIPTION OF THE DRAWINGS

The accompanying drawings, given by way of example, will enable the invention, the characteristics that it presents and the advantages that it is capable of procuring, to be more readily understood.

DESCRIPTION OF THE PREFERRED EMBODIMENTS

Figure 1:
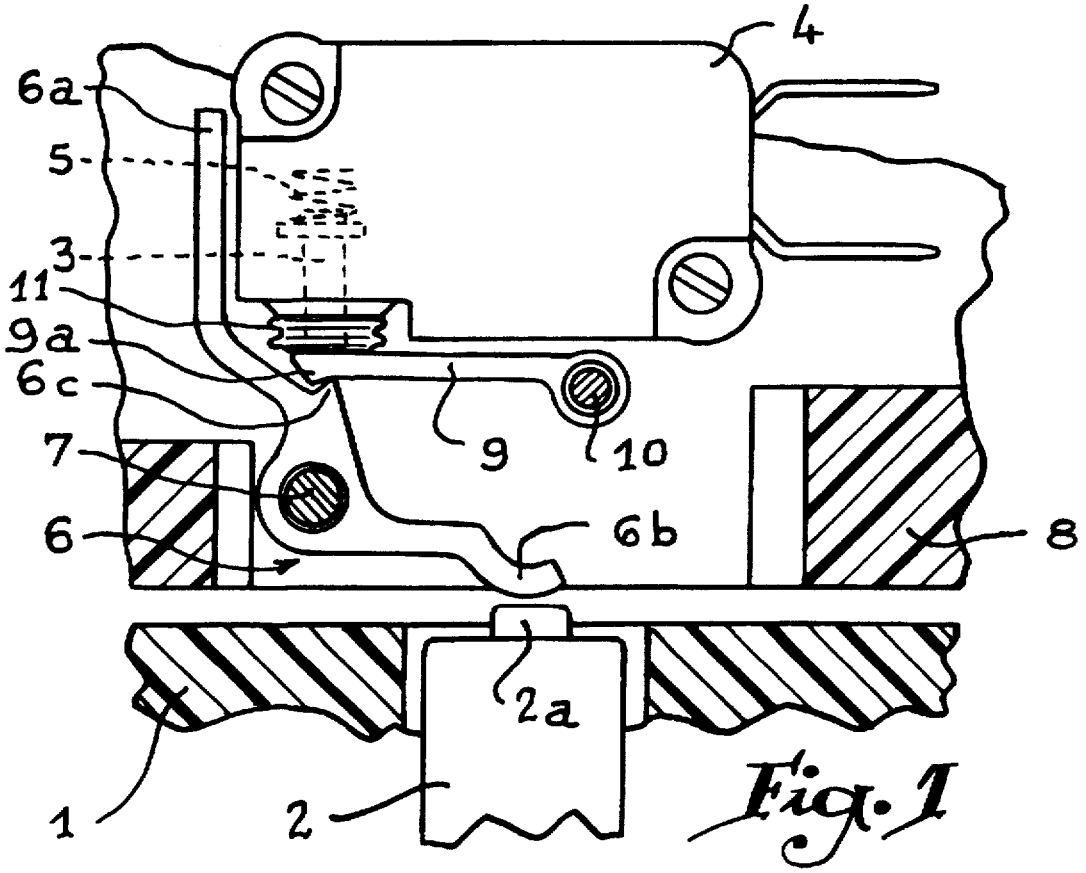
FIG. 1 is a partial section showing the actuation mechanism of the alarm circuit associated with a fuse cartridge according to the invention.

Concerning the arrangement of the body of the cartridge, reference will be made to what has been described and shown in document FR-A-2 685 544 (FERRAZ) mentioned above. In FIG. 1, reference 1 designates the insulating envelope which bears the two conventional connection heads connected to each other on the one hand by the fusible element or elements of the cartridge embedded in the conventional siliceous mass and, on the other hand by the conducting wire of reduced section which retains the striking pin 2 against the elastic means associated therewith. In conventional manner, this striking pin 2, advantageously provided with a central boss 2*a*, is intended to control the actuation knob 3 of an alarm micro-switch 4, such control being effected against the elastic means 5 associated with the knob.

As in the case illustrated in the prior art document mentioned above, between the micro-switch 4 and the striking pin 2, there is interposed a rocking lever 6 which pivots freely on a shaft 7 carried by the insulating support 8 supporting the micro-switch 4. This lever 6 comprises two arms 6*a* and 6*b* oriented at 90° with respect to each other, the free end of arm 6*b* being disposed in the axis of the boss 2*a* of the striking pin 2.

According to the present invention, between the lever 6 and the micro-switch 4, there is mounted a movable arm 9 which is carried by a shaft or pivot 10 oriented parallel to shaft 7 of lever 6. It will be observed that this pivot 10 is located at a relatively large distance from the axis of the actuation knob 3. Furthermore and as clearly shown in FIG. 2, the end of the arm 9 is provided with a projection 9*a* which is turned in the direction of a tooth 6*c* provided on the central part or hub of the lever 6.

Figure 2:
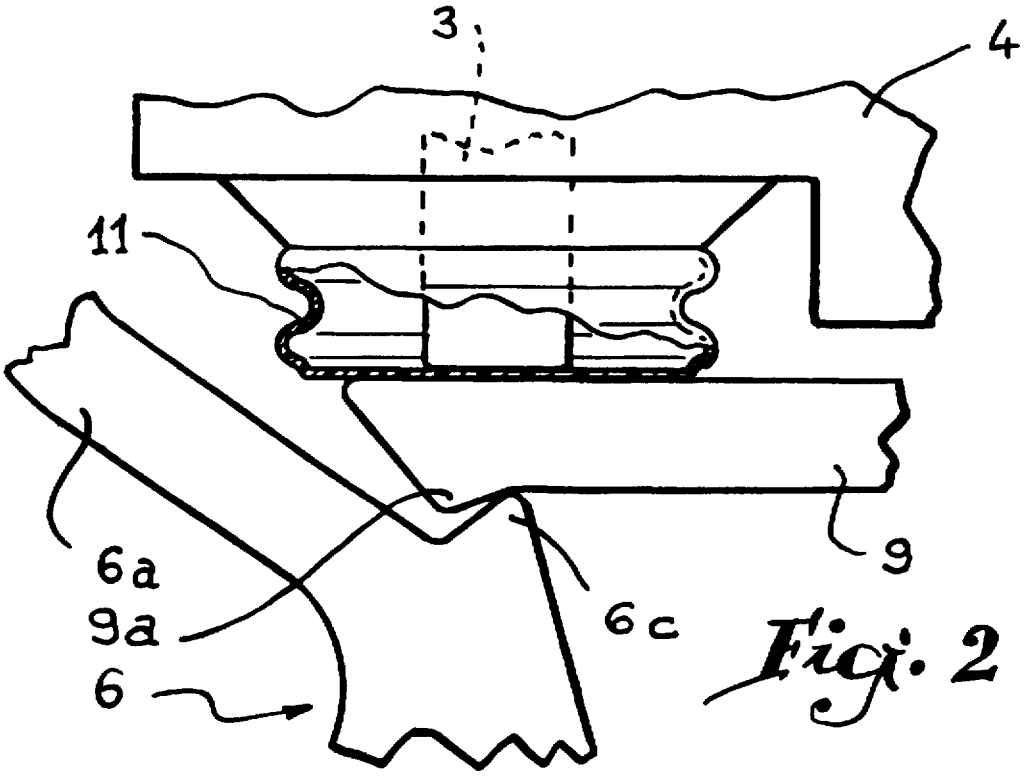
FIG. 2 shows on a larger scale the arrangement of the zone of contact between the rocking lever and the mobile arm of the mechanism according to FIG. 1.

When the cartridge is traversed by a current whose intensity is lower than the nominal, all the pieces are in the standby position shown in FIGS. 1 and 2. The stability of this position is in fact ensured by the pressure exerted by the elastic means 5 on the knob 3 which tends to push the arm 9 against the lever 6, the latter thus being maintained at an orientation such that the end of its arm 6*b* is placed at a short distance from the boss 2*a* of the striking pin 2. The alarm circuit associated with the micro-switch 4 is not supplied.

Figure 3:
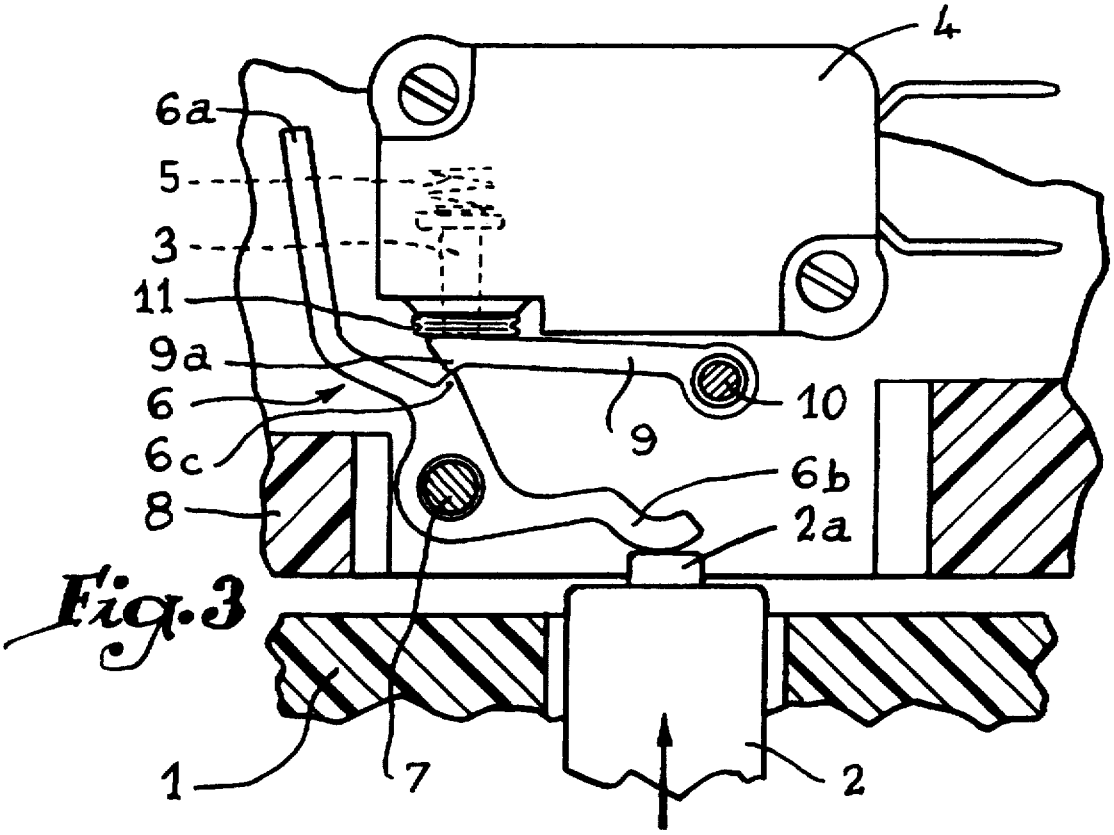
FIGS. 3 and 4 are sections similar to that of FIG. 1 illustrating the operation of the mechanism.

When the striking pin 2 is released, further to the fusion of the fuse element or elements of the cartridge and its retaining wire, its sudden axial displacement provokes, by the boss 2*a* bearing against the arm 6*b*, rocking of the lever 6 about its shaft 7. As shown in FIG. 3, the tooth 6*c* abuts against the projection 9*a* of the arm 9 which moves angularly about its pivot 10 and which thus moves closer to the actuation knob 3 of the micro-switch 4.

Figure 4:
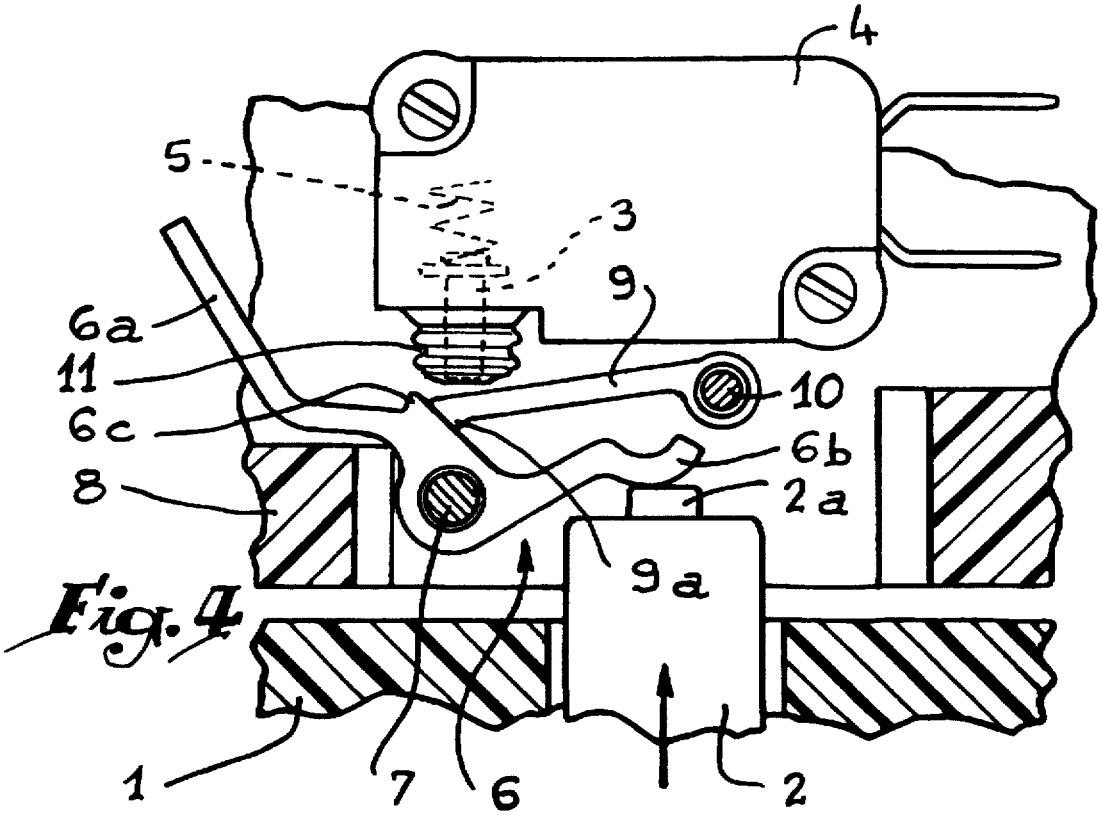

This actuation continuing, the parts are in the position illustrated in FIG. 4 and it will be noted that, although the arm 9 is no longer in contact with the knob 3, the latter has thus changed state and ensures actuation of the micro-switch 4, with the result that the alarm circuit operates. This position is rendered perfectly stable due to the retention exerted by the projection 9*a* of the arm 9 against the hub of the lever 6.

It is essential to observe that the passage from the standby position according to FIGS. 1 and 2 to the temporary actuation position according to FIG. 3 is effected, due to the pivot 10 moving away, virtually without relative lateral displacement of parts 9 and 3. A pressure without a relative sliding movement is therefore produced, with the result that the micro-switch 4 is actuated under excellent conditions whatever the surface state of the parts in contact, even in the case of the knob 3 being mounted, as is assumed in the drawing, inside a (flexible) cap 11 formed, in the example illustrated, by a deformable bellows made of a material such as a silicone whose coefficient of friction is very high.

It will be appreciated that the pivot 10 of the arm 9 may be oriented perpendicularly to the axis 7 of the lever 6 without changing operation of the assembly, as long, of course, as this pivot 10 is sufficiently distant from the axis of the knob 3 for its rocking under the effect of the striking pin to involve virtually no axial displacement of its free end.

It must, moreover, be understood that the foregoing description has been given only be way of example and that it in no way limits the domain of the invention which would not be exceeded by replacing the details of execution described by any other equivalents.

I claim:

1. In a fuse cartridge incorporating an actuation indicator of the type in which a rocking lever has a central part including an outwardly extending profiled part and wherein the rocking lever is pivotally mounted on a first pivot shaft so as to pivot in response to an arm of the rocking lever being engaged by a striking pin, and wherein the pivotable movement of the rocking lever is used to control the movement along an axis of a knob associated with an alarm micro-switch and which knob is normally retained in a first position by a resilient element, the improvement comprising:

an arm member having one end mounted to a second pivot shaft and having an outer end portion extending therefrom so as to be positioned between the profiled part of the rocking lever and the knob of the micro-switch, said outer end portion having said arm member being in contact with said profiled part of the rocking lever and the knob of the micro-switch when the knob is in the first position, and said outer end portion of said arm member being spaced from said second pivot shaft a distance such that when the striking pin engages the arm of the rocking lever, the profiled part of the rocking lever will initially urge said outer end portion of said arm member to move the knob along the axis to a second position inwardly of the micro-switch in such a manner that there is substantially no lateral sliding movement between the outer end portion of said arm member and the knob and thereafter said outer end portion of said arm member will engage the central portion of the rocking device at a point spaced from the profiled part to thereby allow the knob to move along the axis outwardly to a third position wherein said outer end portion of said arm member is spaced from the knob.

2. The fuse cartridge of claim 1 in which said outer end portion of said arm member includes a projection extending toward the rocking lever, said projection being engageable by the profiled part of the rocking lever when the striking pin initially engages the arm of the rocking lever.

3. In a fuse cartridge incorporating an actuation indicator of the type in which a rocking lever has a central part including an outwardly extending profiled part and wherein the rocking lever is pivotally mounted on a first pivot shaft so as to pivot in response to an arm of the rocking lever being engaged by a striking pin, and wherein the pivotable movement of the rocking lever is used to control the movement along an axis of a knob associated with an alarm micro-switch and which knob is normally retained in a first position by a resilient element and wherein a flexible cap covers the knob, the improvement comprising:

an arm member having one end mounted to a second pivot shaft and having an outer end portion extending therefrom so as to be positioned between the profiled part of the rocking lever and the flexible cap covering the knob of the micro-switch, said outer end portion having said arm member being in contact with said profiled part of the rocking lever and the flexible cap covering the knob of the micro-switch when the knob is in the first position, and said outer end portion of said arm member being spaced from said second pivot shaft a distance such that when the striking pin engages the arm of the rocking lever, the profiled part of the rocking lever will initially urge said outer end portion of said arm member to move the knob along the axis to a second position inwardly of the micro-switch in such a manner that there is substantially no lateral sliding movement between the outer end portion of said arm member and the knob and thereafter said outer end portion of said arm member will engage the central portion of the rocking device at a point spaced from the profiled part to thereby allow the knob to move along the axis outwardly to a third position wherein said outer end portion of said arm member is spaced from the knob.

4. The fuse cartridge of claim 3 in which said outer end portion of said arm member includes a projection extending toward the rocking lever, said projection being engageable by the profiled part of the rocking lever when the striking pin initially engages the arm of the rocking lever.

* * * * *